US006536347B1

(12) United States Patent
Zacharin

(10) Patent No.: US 6,536,347 B1
(45) Date of Patent: Mar. 25, 2003

(54) TIME DELAY LATCH DEVICE

(75) Inventor: Alexey T. Zacharin, Silver Springs, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 31 days.

(21) Appl. No.: 09/888,628

(22) Filed: Jun. 20, 2001

(51) Int. Cl.[7] ..... F42C 1/02

(52) U.S. Cl. ..... 102/274; 102/253; 102/415; 89/1.55

(58) Field of Search ..... 102/253, 274, 102/415; 89/1.55

(56) References Cited

U.S. PATENT DOCUMENTS 2,399,307 A * 4/1946 Allen, Jr. ..... 102/415
3,718,093 A * 2/1973 Milanowski ..... 102/274 X
3,842,740 A * 10/1974 Mirlesse ..... 102/253 X
3,948,176 A * 4/1976 Koomen ..... 102/274 X
4,322,998 A * 4/1982 Fowler et al. ..... 89/1.55
4,440,060 A * 4/1984 Berkley ..... 89/1.55
4,811,470 A * 3/1989 Van Sloun ..... 89/1.55 X
5,003,881 A * 4/1991 Herold et al. ..... 102/253 X
5,104,067 A * 4/1992 McIntyre et al. ..... 102/274 X
5,394,802 A * 3/1995 Rohrle ..... 102/274

* cited by examiner

*Primary Examiner*—Peter A. Nelson
(74) *Attorney, Agent, or Firm*—John F. Moran

(57) ABSTRACT

A time delay latch device of the arming assembly of a delay fuze which replaces the current system in support of the U.S. Navy Mine Clearing Program. The time delay mechanism is a mechanical run-away escapement having a one-half pound release force that unlatches an 800-pound load. The mechanical force reduction mechanism that makes up the latch device consists of 10 components rather than the existing 31 and a pyrotechnic time delay mechanism consisting of two components in lieu of the existing 14. Hence, the latch device taught herein provides not only the requisite delay and required latch release force but also reduces the total number of components from 44 to 12; thus creating significant cost savings in manufacturing. Time delay latch mechanism is located within the ram shaft that holds the ram shaft spring captive between the ram shafts and housing. The latching mechanism for the ram shaft comprises two ball detents located within the ram shaft and held in place by the housing. Ball detents hold captive a firing pin detent that holds under compression a firing pin spring. A pyrotechnic timing and release element contains a primer, a pyrotechnic delay mix and a propellant.

6 Claims, 3 Drawing Sheets

TIME DELAY LATCH DEVICE

U.S. GOVERNMENT INTEREST

The invention described herein may be manufactured, used or licensed by or for U.S. Government purposes without the payment of royalties thereon.

BACKGROUND OF INVENTION

I. Field of Invention

This invention applies to the field of mechanical safe and arming devices used on fuzes. In particular, the invention herein involves a time delay latch mechanism located within the Arming Assembly of an arm fire device which is part of the delay fuze used in the U. S. Navy Mine Clearing program.

II. Background of the Invention

U.S. Navy is in the process of developing a Fuze, Delay for the Mine Clearing Program. Part of this Fuze is an Arm Fire Device, containing an Arming Assembly a portion of which is a Latch Mechanism. This latch mechanism must latch an 800 pound spring load and, upon certain time delay, release this load. The time delay mechanism is a mechanical run-away escapement having a one-half pound release force. This force has to unlatch the 800 pound load. To accomplish this, a force reduction mechanism, consisting of 31 components and a time delay mechanism, consisting of fourteen (14) components were used, totaling 44 components. The Time Delay Latch mechanism herein was designed to provide the requisite delay, to provide the desired latch release force and to reduce the number of parts.

Accordingly, it is an object of this invention to reduce the number of parts of the existing latch mechanism from 44 to 12. This alternative load release mechanism, whose preferred embodiment, is described herein consists of 10 components. The pyrotechnic time delay device consists of two components. This reduction translates into reduced costs of materials and manufacturing costs, thus providing significant savings to the U.S. Government.

Another object is to require less volume in the design envelope by locating the time delay latch mechanism with the Arming Assembly.

Yet, another object is to provide a latch release force of approximately 200 pounds which with a factor of safety of two, translates into 6000 phi of propellant force; more over the provided volume can deliver up to 10000 psi, if desired.

Finally, the last object is to provide a unique application of mechanical and energetic materials to achieve the objects described above.

SUMMARY OF INVENTION

It has now been discovered that the above and other objects of the present invention may be accomplished by the following mechanism and in the following manner.

The time delay latch mechanism is located within a ram shaft that holds a ram shaft spring captive between the ram shaft and housing. The latching mechanism for the ram shaft consists out of two ball detents located within the ram shaft and held in place by the housing. Ball detents hold captive a firing pin/detent which holds under compression a firing pin spring. A pyrotechnic timing and release element contains a primer, a pyrotechnic delay mix, and a propellant. The process is initiated with the release of the firing pin/detent propelled by the firing pin spring that will push the ball detents into the housing cavity thus locking the ram shaft in the cocked position. Pushing past the ball detents, the firing pin/detent at the same time will initiate the primer which in turn will initiate the delay mix which in turn will initiate the propellant to provide the pressure to push the firing pin /detent back and unlock the detents.

BRIEF DESCRIPTION OF THE PREFERRED DRAWINGS

The features of the present invention and the manner of attaining them will become apparent, and the invention itself will be understood by reference to the following description and the accompanying drawings. In these drawings, like numerals refer to the same or similar elements. The sizes of the different components in the figures might not be in exact proportion and are shown for visual clarity and for the purpose of explanation.

FIG. 1 is a cross sectional overview of the latch mechanism.

FIG. 2 is a cross sectional view of the latch mechanism in the safe/functioned position.

FIG. 3 is a cross sectional view of the latch mechanism in the cocked position.

BRIEF DESCRIPTION OF THE DRAWING

The time delay latch device 10 according to the first embodiment of the present invention is depicted in FIGS. 1–3. With particular reference to FIGS. 1 and 2, the time delay latch mechanism 10 is located within the ram shaft 11 which is holding the ram shaft spring 18 captive between the ram shaft 11 and housing 19.

The latching mechanism 10 for the ram shaft 11 consists out of two ball detents 15 located within the ram shaft 11 and held in place by the housing 19.

The sequence of operation is described at FIGS. 2, 3. Upon deployment of the SABRE system, an arming cable will pull on the ram shaft 11, shown at FIGS. 2, 3, with a force of 1000 pounds until the arming cable breaks.

Figure 3:
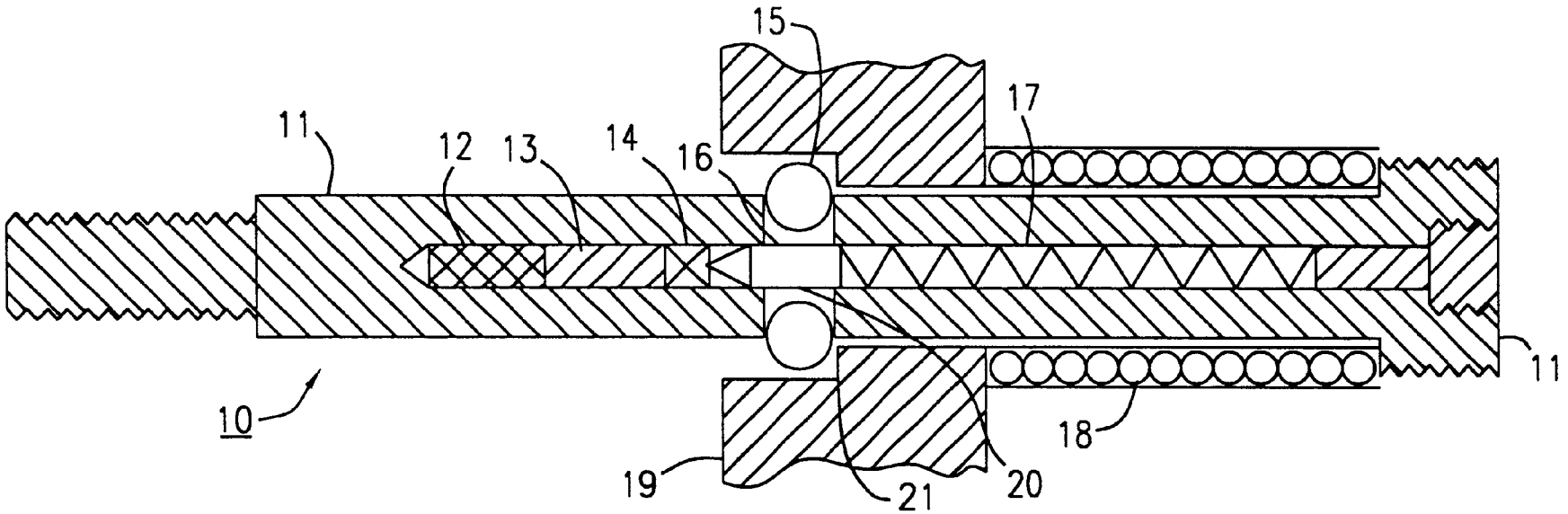
FIG. 3 shows the ram shaft 11 pulled out to a point where the ram shaft spring 18 is fully compressed.

The ball detents 15 are aligned with the housing 9 cavity. The firing/pin detent 16 propelled by the firing pin spring 17 will push the ball detents 15 into the housing 19 cavity, thus locking the ram shaft 11 in the cocked position shown at FIG. 3.

Pushing past the ball detents 15, the firing pin/detent 16 at the same time will initiate primer 14, which in turn will initiate delay mix 13. Delay mix 13 will burn for a preselected number of seconds and initiate the propellant 12.

Figure 1:
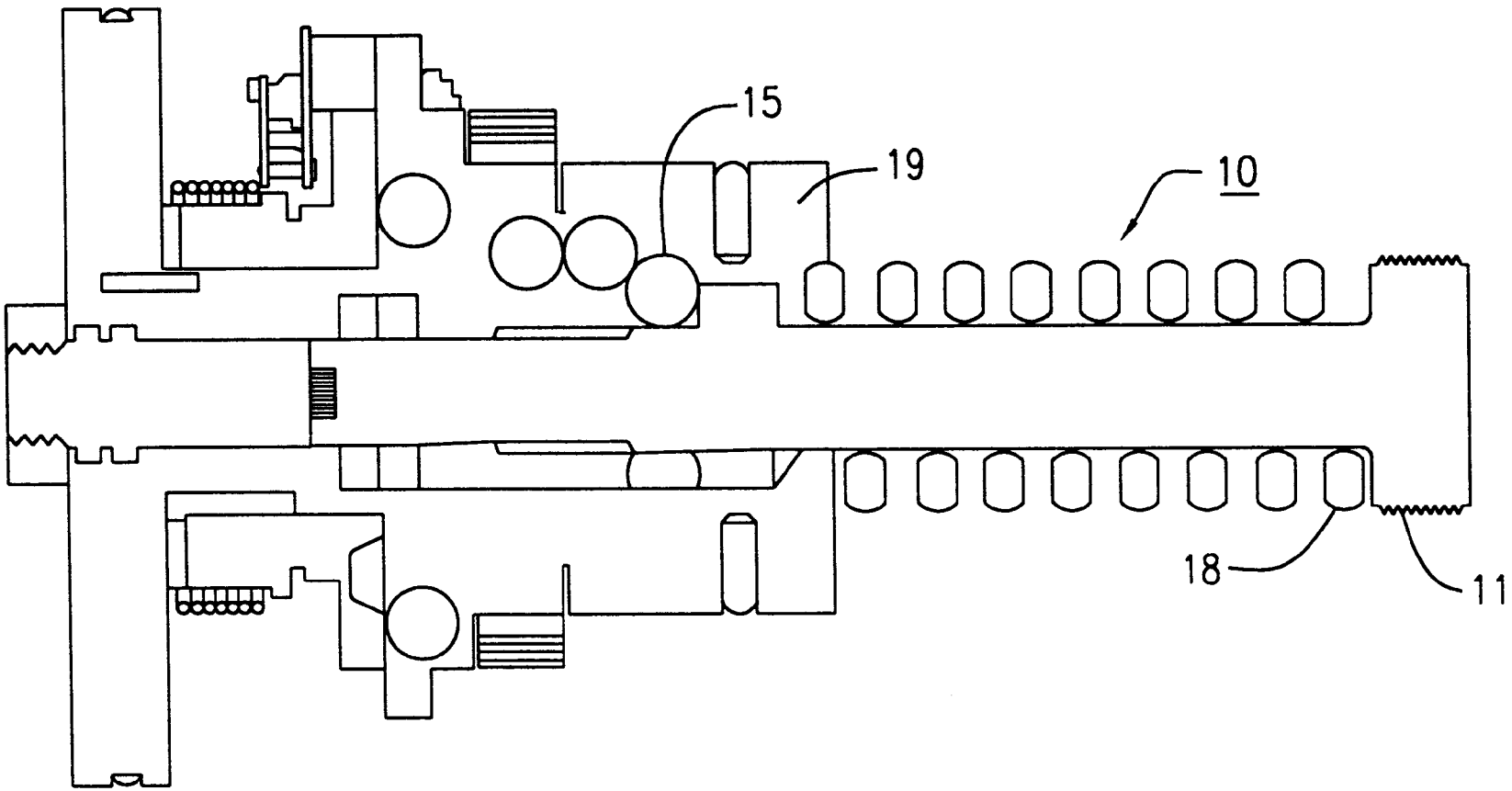
Figure 2:
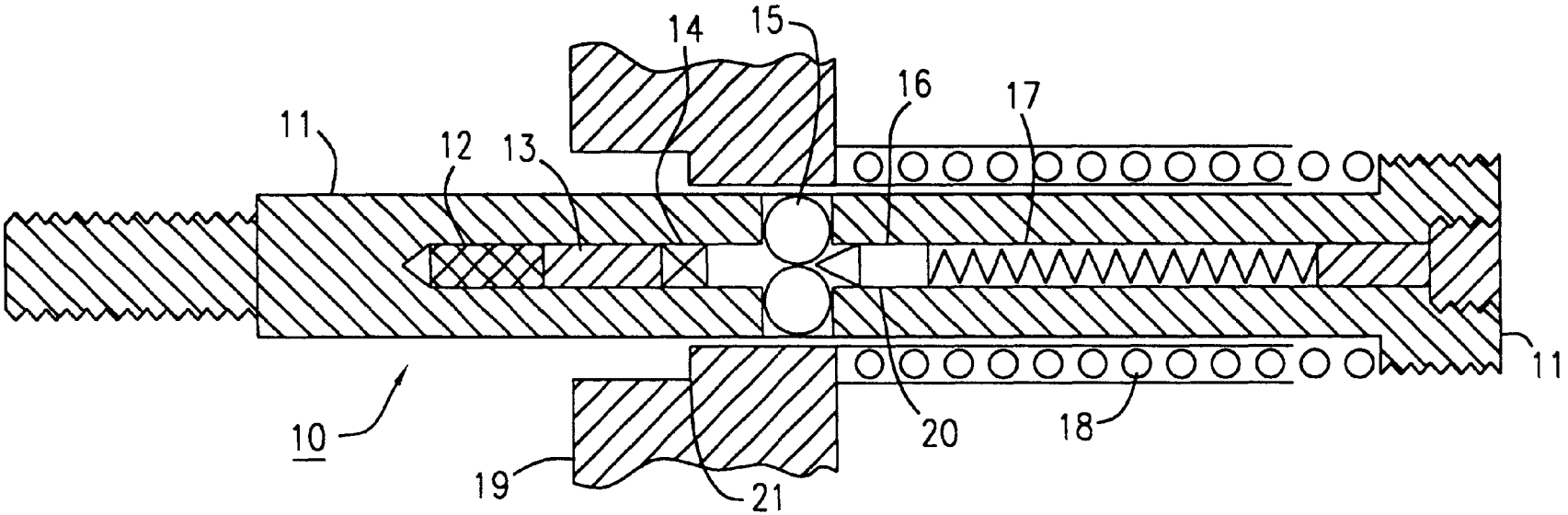
FIG. 2 shows the ball detents 15 holding captive the firing pin /detent 16 which in turn holds under compression the firing pin spring 17. A pyrotechnic timing and release element 20 contains the primer 14, the pryrotechnic delay mix 13 and the propellant 12.

The propellant 12 will develop sufficient pressure to push the firing pin/detent 16 back and unlock ball detents 15. As soon as the firing pin/detent 16 releases the ball detents 15, the ram shaft spring 18 will push the ram shaft 11 back and the ball detents 15 will be pushed into the ram shaft 11 by a ramp 21, whose angle is set to some 30 degrees or as required in the housing 19, unlatching the ram shaft 11. The ram shaft spring 18 will push ram shaft 11 to the full travel as shown at FIG. 2.

The embodiments described herein are included for the purposes of illustration, and are not intended to be exclusive; rather, they can be modified within the scope of the invention. Other modifications may be made when implementing the invention for a particular application.

What is claimed is:

1. A time delay mechanism within a mechanical safe and arming device located within a ram shaft wherein the time delay mechanism comprises:

means for latching to hold the ram shaft spring captive between the said ram shaft and housing;

means for releasing the load after the arming cable pulls on the said ram shaft until said cable breaks; and means for time delay.

2. A time delay mechanism within a mechanical safe and arming device located within an arm shaft as in claim 1 wherein the means for latching to hold the ram shaft spring captive between the ram shaft and housing further comprises:

two ball detents located within the said ram shaft and held in place by the said housing; and a firing pin/detent held in place by the said ball detents to hold under compression a firing pin spring.

3. A time delay mechanism within a mechanical safe and arming device located within an arm shaft as in claim 2 wherein the said firing pin spring is held under compression of 800 pounds.

4. A time delay mechanism within a mechanical safe and arming device located within an arm shaft as in claim 1 wherein the means for releasing the load after the arming cable pulls on the ram shaft until said cable breaks comprises:

a firing pin detent propelled by the said firing pin spring to push the said ball detents into the housing cavity thus locking the shaft in the cocked position;

pushing past the said ball detents, the firing pin/detent, concurrently initiates the time delay means.

5. A time delay mechanism within a mechanical safe and arming device located within an arm shaft as in claim 1 wherein the means for time delay is a pyrotechnic delay device.

6. A time delay mechanism within a mechanical safe and arming device located within an arm shaft as in claim 5 wherein the said pyrotechnic delay device comprises:

a primer to inititate a delay mix;

a delay mix set to burn for a preselected number of seconds; and a propellant initiated by the delay mix to develop pressure (6000 psi;

volume can deliver up to 10,000 psi) to push the firing pin/detent back and unlock the said ball detents.

* * * * *